US008552830B2

(12) United States Patent
Mikoshiba et al.

(10) Patent No.: US 8,552,830 B2
(45) Date of Patent: Oct. 8, 2013

(54) AMORPHOUS TRANSFORMER

(75) Inventors: Ryosuke Mikoshiba, Shibata (JP); Hiroyuki Endo, Agano (JP); Kenji Nakanoue, Tainai (JP); Toshiaki Takahashi, Tainai (JP); Tooru Honma, Shibata (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 0 days.

(21) Appl. No.: 13/184,155

(22) Filed: Jul. 15, 2011

(65) Prior Publication Data

US 2012/0161915 A1 Jun. 28, 2012

(30) Foreign Application Priority Data

Dec. 27, 2010 (JP) ..... 2010-289858

(51) Int. Cl.

| | |
|---|---|
| ***H01F 27/26*** | (2006.01) |
| ***H01F 27/24*** | (2006.01) |
| ***H01F 27/06*** | (2006.01) |
| ***H01F 17/04*** | (2006.01) |

(52) U.S. Cl.
USPC ..... 336/210; 336/212; 336/67; 336/221

(58) Field of Classification Search
USPC ..... 336/65–68, 210, 212, 213, 221
See application file for complete search history.

(56) References Cited

U.S. PATENT DOCUMENTS

| | | | | |
|---|---|---|---|---|
| 2,906,977 A | | 9/1959 | Rowley et al. | |
| 2,930,012 A | * | 3/1960 | Hufnagel | 336/178 |
| 3,662,308 A | * | 5/1972 | Muschong | 336/210 |
| 3,774,298 A | * | 11/1973 | Eley | 29/605 |
| 4,260,975 A | * | 4/1981 | Wilcox et al. | 336/65 |
| 4,709,471 A | * | 12/1987 | Valencic et al. | 29/605 |
| 5,226,222 A | | 7/1993 | Hanaoka et al. | |
| 5,608,371 A | * | 3/1997 | Valencic et al. | 336/210 |
| 5,684,446 A | * | 11/1997 | Adkins et al. | 336/92 |
| 2002/0057180 A1 | * | 5/2002 | Shirahata et al. | 336/213 |
| 2009/0128276 A1 | * | 5/2009 | Horowy et al. | 336/96 |

FOREIGN PATENT DOCUMENTS

| | | | |
|---|---|---|---|
| CA | 2048707 A1 | | 2/1992 |
| EP | 0 474 371 A2 | | 3/1992 |
| JP | 09-129464 | | 5/1997 |
| JP | 09-129464 A | * | 5/1997 |
| JP | 2001-196234 | | 7/2001 |
| JP | 2005-286169 A | | 10/2005 |

OTHER PUBLICATIONS

Extended European Search Report issued in European Patent Application No. 11172669.1 dated Jun. 8, 2012.
Japanese Office Action issued in Japanese Application No. 2010-289858 dated Apr. 23, 2013.

* cited by examiner

*Primary Examiner* — Elvin G Enad
*Assistant Examiner* — Mangtin Lian
(74) *Attorney, Agent, or Firm* — McDermott Will & Emery LLP

(57) ABSTRACT

An amorphous transformer which includes an amorphous core formed of an amorphous material with a lap provided at an upper portion and allowed to stand in substantially a vertical direction while being supported at a core support member, and a coil which is fitted with the amorphous core. The core support member is formed by integrating a core support member for supporting a side surface of the amorphous core and a corner support member for supporting a corner portion of the core. The core support member is provided in substantially a vertical direction along at least one of the side surfaces of the core.

2 Claims, 7 Drawing Sheets

AMORPHOUS TRANSFORMER

CLAIM OF PRIORITY

The present application claims priority from Japanese Patent Application JP 2010-289858 filed on Dec. 27, 2010, the content of which is hereby incorporated by reference into this application.

BACKGROUND

The present invention relates to a technology for providing an amorphous transformer, and more particularly, to a support member used for assembly while allowing an amorphous core to stand.

Recently, the transformer using non-crystalline magnetic alloy and amorphous material has been developed.

When employing the amorphous material for forming the transformer core, the measure for preventing scattering of the amorphous fragment needs to be taken. Japanese Unexamined Patent Publication No. 2001-196234 discloses the vessel for preventing scattering of the fragments, which is structured to have two metal tubular shapes each having a rectangular cross-section. The inverted U-like amorphous core is inserted into the vessel, and square box-like lids are provided at top and bottom sides to prevent scattering of the amorphous fragments.

Japanese Unexamined Patent Publication No. 9-129464 discloses the structure which suppresses generation of the fragments from the amorphous thin band upon assembly of the amorphous core as shown in FIG. 25. The drawing represents a corner support for 3-phase core at the corner portion of the mount frame.

However, Japanese Unexamined Patent Publication Nos. 2001-196234 and 9-129464 do not disclose the support member used for assembly while allowing the core to stand.

FIG. 7 shows the task to be achieved for allowing the amorphous core to stand for assembly, which will be described hereinafter.

When an amorphous core 710 having a lap released is inserted into a box 700 as a core support member for assembly, the corner portion defined by the long and short sides of the amorphous core changes from the state shown in FIG. 7 owing to its own weight. In other words, a corner portion 712 of the core sinks owing to its own weight, which no longer capable of retaining its core configuration as designed.

If configuration of the core corner portion cannot be retained, there may be the risk of failing to bond the lap after fitting of the coil.

As the core becomes large, its own weight is increased, thus increasing the coil dimension and weight. It is therefore expected to complicate the work for fitting the coil with the core, thus requiring a certain structure to allow the core to stand.

SUMMARY OF THE INVENTION

The present invention ensures to allow the amorphous core to stand in good condition for preventing sink of the corner portion of the core that is let stand, thus smoothly assembling the core and the coil.

The present invention provides an amorphous transformer which includes an amorphous core formed of an amorphous material with a lap provided at an upper portion and allowed to stand in substantially a vertical direction while being supported at a core support member, and a coil which is fitted with the amorphous core. The core support member is formed by integrating a core support member for supporting a side surface of the amorphous core and a corner support member for supporting a corner portion of the core.

In the amorphous transformer, the core support member is provided in substantially a vertical direction along at least one of the side surfaces of the core.

In the amorphous transformer, the corner support member has a shape which follows an R (radius) of the corner portion of the core.

In the amorphous transformer, the core and the coil are assembled by inserting the amorphous core and the core support member for supporting the side surface of the amorphous core into the coil.

The present invention provides an amorphous transformer which includes an amorphous core formed of an amorphous material with a lap provided at an upper portion and allowed to stand in substantially a vertical direction while being supported at a core support member, and a coil which is fitted with the amorphous core. The core member has a box-like shape, one end of which allows the core to be inserted, and the other end of which is provided with a gap at a portion corresponding to the corner portion of the core. A corner support member is formed by filling the gap with metal sticks.

The present invention allows the core for the amorphous material to stand so that the coil is smoothly fitted while minimizing the load to the amorphous core and the coil in the state where the core is let stand. Approach to the problem of the core corner portion which sinks owing to its own weight may further be improved compared to the related art, thus simplifying bonding of the lap and improving bonding.

Even if the transformer is vibrated at the time of transportation, weakening of bonding to the lap may be prevented compared to the related art. As change in the configuration of the core corner owing to vibration during transportation may be suppressed, it may be expected to retain the transformer properties in good conditions.

DESCRIPTION OF THE PREFERRED EMBODIMENTS

Figure 1A:
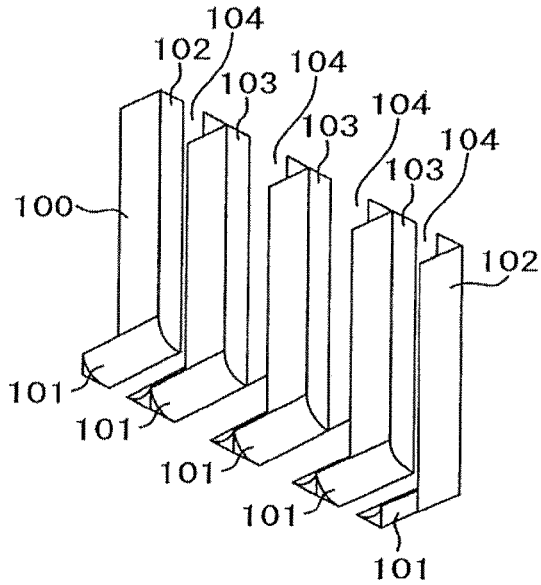
FIG. 1A is a perspective view showing an integrated structure of core support members for supporting amorphous cores of the amorphous transformer according to the present invention and corner support members for preventing sink of the corner portion.

Examples of an amorphous transformer according to the present invention will be described referring to the drawings.

Example 1

FIGS. 1A to 1D are perspective views of an example of an amorphous transformer according to the present invention, showing a series of operations for assembling the coil with the amorphous core. This example will be described with respect to the use of 3-phase 5-leg amorphous core transformer.

FIG. 1A illustrates a core support member 100 for supporting an amorphous core, and a corner support member 101 for preventing sink of a corner portion of the amorphous core. The core support member 100 stands substantially in a vertical direction along the side surface of the wound amorphous core having the lap at the upper portion, and has a height substantially equal to the one in the state where the lap of the amorphous core is opened. However, the height is not limited to the one as described above. A gap 104 is formed between adjacent support plates 102 and 103, through which a wound coil 120 is fitted with the core while having the lap opened. The core 110 and the support plate 103 are inserted into the coil 120 and the lap is bonded. The corner support member 101 for the amorphous core is fabricated based on the radius R of the corner portion of the wound amorphous core, and provided on a portion corresponding to the corner portion of the core for the purpose of preventing sink of the corner portion of the amorphous core owing to its own weight. The core support member 100 and the corner support member 101 are integrated through welding so as not to be broken under the weight of the core.

Figure 1B:
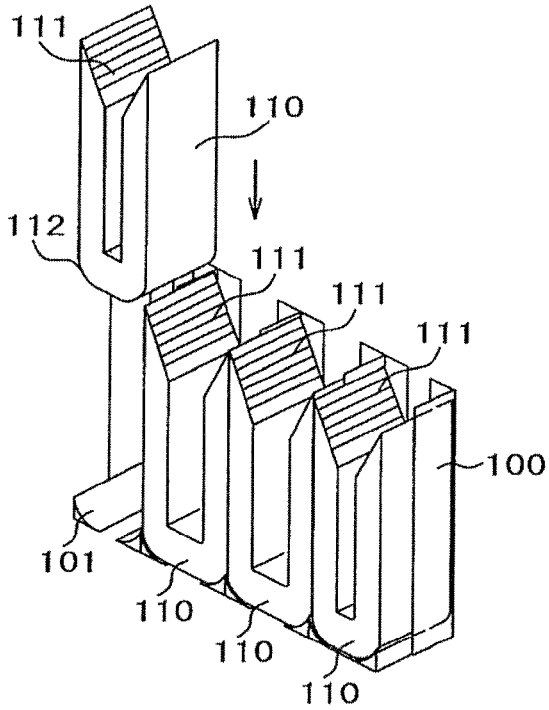
FIG. 1B is a perspective view showing the state where the amorphous core is set in the core support member for the amorphous core and the corner support member according to the present invention.

FIG. 1B shows the state where the amorphous core is set in the integrated structure of the core support member 100 and the corner support member 101. The length of the corner support member 101 is set to be substantially the same as width of the amorphous core. The corner support members 101 are provided at all the corner portions of the cores. Each of both ends and inner side of the core support member 100 has an L-like shape and a T-like shape, respectively. The resultant space of the respective support plates accommodates the cores. The core is set while being hung from above.

Figure 1C:
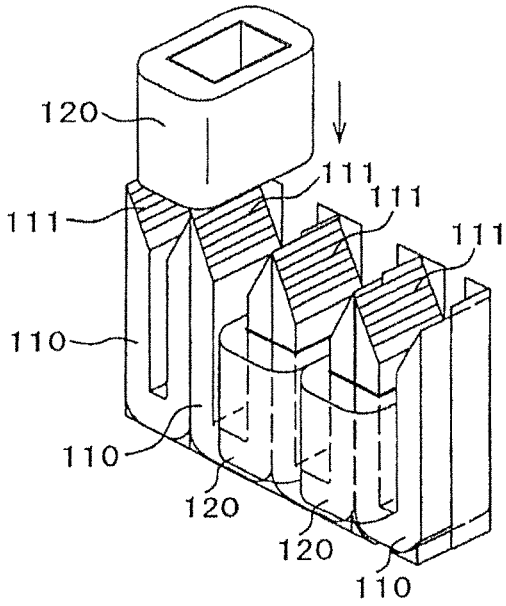
FIG. 1C is a perspective view showing the state where the amorphous core is set in the core support member for the amorphous core and the corner support member according to the present invention, and then the amorphous core is inserted into a coil.

FIG. 1C shows the state where the amorphous core is set in the integrated structure of the core support member 100 and the corner support member 101, which are further inserted into the coil 120. Referring to FIG. 1C, laps 111 of the two adjacent cores at the upper side, and the core support members 100 are inserted into the coil 120. The drawing represents the state where the left coil 120 is about to be fitted with the core from above. The coil 120 is hung down for positioning so as to be fitted with the core 110 for setting.

Figure 1D:
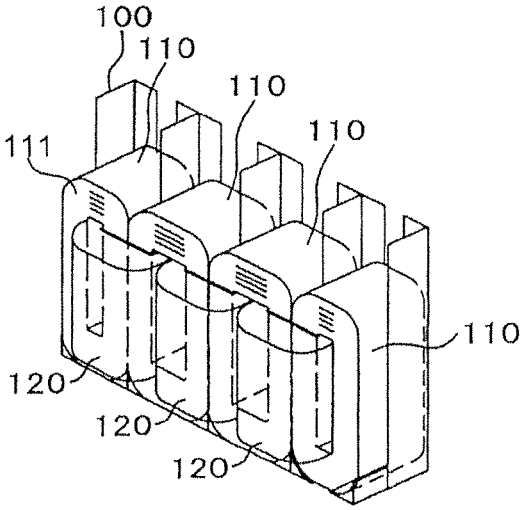
FIG. 1D is a perspective view showing the state where the amorphous cores are set in the core support members for the amorphous cores and the corner support members according to the present invention, the amorphous core is inserted into the coil, and laps are bonded.

FIG. 1D shows the state where the coil 120 is fitted with the core 110, and then the laps 111 of the amorphous core are bonded. The corner support members 101 are provided below the corner portion of the core so as to prevent sink of the corner portion of the core owing to its own weight. When the laps are bonded as shown in FIG. 1D, assembly of the core and the coil is completed.

Example 1 allows the amorphous core 110 to stand, and the approach to the problem resulting from sink of the corner portion owing to the self weight of the amorphous core 110 is significantly improved compared to the related art. This makes it possible to easily conduct bonding of the lap portion 111, resulting in good bonding. As the corner support member suppresses the sink of the corner portion of the core, the properties may be retained in spite of aging variation.

In the structure according to the present invention, the amorphous core 110 is supported with the core support member 100 to stand, thus allowing smooth fitting of the coil in the self-supported state. This makes it possible to largely increase the work efficiency.

Example 2

Figure 2A:
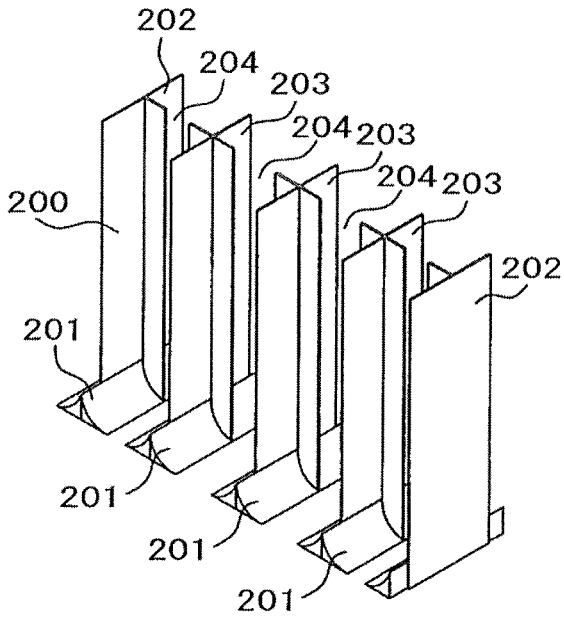
FIG. 2A is a perspective view showing another example of an integrated structure of core support members and corner support members in case of an amorphous transformer with 3-phase 5-leg having the cores arranged in two rows according to the present invention.
Figure 2B:
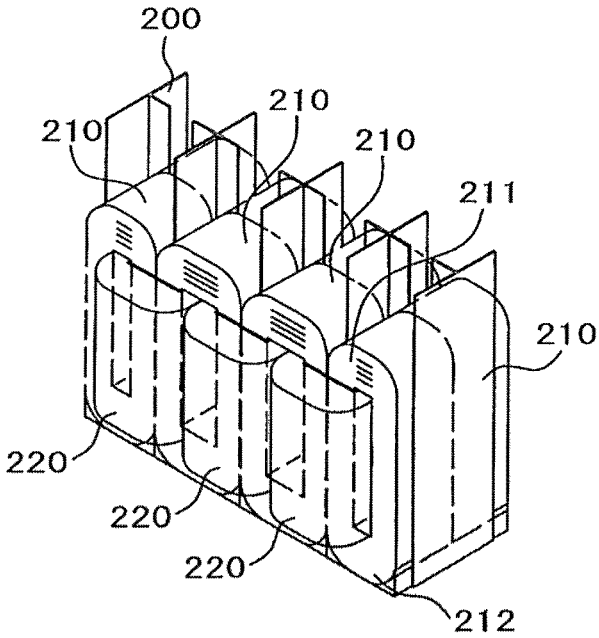
FIG. 2B is a perspective view showing the state where the cores and the coils are set in the integrated structure of the core support members and the corner support members, to which laps of the cores are bonded in case of the amorphous transformer with 3-phase 5-leg having the cores arranged in two rows according to the present invention.

FIGS. 2A and 2B show the core assembly of the 3-phase 5-leg amorphous core transformer having the cores arranged in two rows, core support member 200, and corner support members 201.

FIG. 2A is a perspective view of the core support member 200 and the corner support members 201 for arranging the cores in two rows. Each of the inner side and both ends of the core support member 200 has a cross-like shape 203 and a T-like shape 202, respectively. The amorphous core is set in the space 204 defined by a protruding support plate with cross-like shape, and the space 204 defined by the side plate with T-like shape and the protruding support plate with cross-like shape. The corner support member 201 is provided at the portion corresponding to a corner portion 212 of the amorphous core to be set. The resultant structure is the same as the one shown in FIG. 1A.

FIG. 2B is a perspective view showing the cores and coils of the 3-phase 5-leg amorphous transformer in two rows, which are set in the support member 200. Referring to FIG. 2B, assembly of the amorphous core and the coil will be described. The amorphous cores 210 are arranged in two rows at the protruding support plates with the cross-like shapes while having the laps 211 opened. Then the coil 220 is fitted with the adjacent inner sides of the cores. At this time, the single coil 220 is fitted with the inner support plate with cross-like shape and the cores in two rows altogether. In this case, the width of the transformer core shown in FIG. 2B is larger than that of the transformer core shown in FIG. 1D. Increase in the width of the core makes it possible to provide the transformer with large capacity.

The cores in two rows may be arranged and set in the support members while having the laps 211 opened likewise the case having cores in a single row so that those cores are allowed to stand with the corner support members and the core support members. This makes it possible to smoothly fit the coil 220, thus remarkably improving workability.

Figure 3:
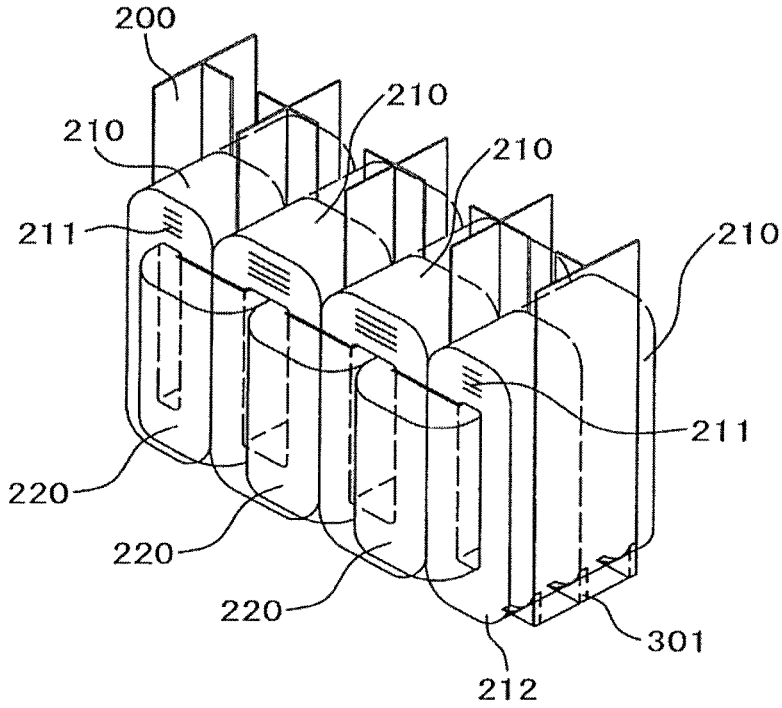
FIG. 3 is a perspective view of a core assembly when using the corner support members according to another example of the present invention.

FIG. 3 is a perspective view showing that the cores are arranged in the core support member 200 in two rows, the coils 220 are fitted, and the laps 211 of the cores are bonded for assembling.

The structure shown in FIG. 3 is different from the one shown in FIG. 2B in a corner support member 301. The corner support member 301 shown in FIG. 3 has a support portion that is not continuous for accommodating the corner portion of the core, each of which has a predetermined width. A plurality of those support portions are arranged at substantially uniform intervals. The accommodating portion of the corner support member 301 has the same configuration as that of the corner portion of the core.

Example 3

Figure 4A:
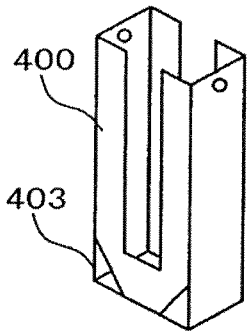
FIG. 4A is a perspective view of a box-shaped core support member according to another example of the present invention.
Figure 4B:
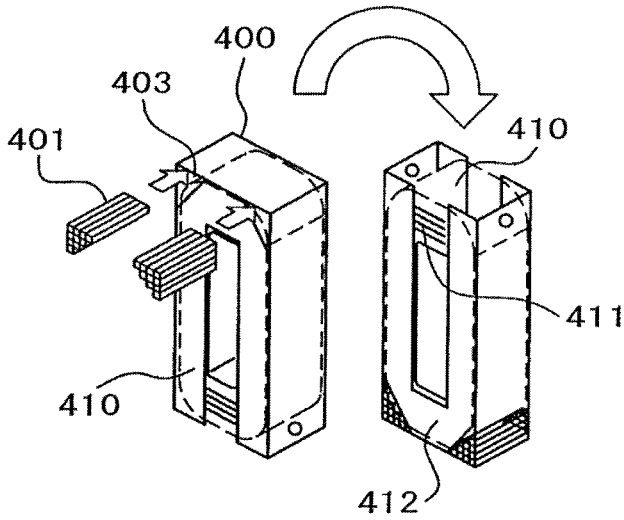
FIG. 4B is a perspective view showing the state where the amorphous core is inserted into the box-shaped core support member according to the present invention, and the lap is bonded, which is then inverted upside down.

FIGS. 4A-4B shows another example of the core support member having a core support member 400 and a corner support member 401 not integrated.

FIG. 4A is a perspective view of the core support member 400 of box shape. FIG. 4B represents a state where the amorphous core is inserted into the box-shape core support member 400, a core corner support member is inserted into the corner portion, which is then inverted upside down.

Referring to FIG. 4A, the core support member 400 will be described. The core support member 400 has a long box shape, that is, a cuboidal shape having one smallest side open so that the amorphous core is inserted. The corner portion at the other side has a space (gap) so that the corner portion of the core is supported, and a window 403 through which an object is externally inserted. The box-shaped core support member has a thin and long cut portion through which the coil is inserted so as to form the box-like shape into the U-like shape.

Referring to FIG. 4B, the amorphous core is inserted from the open side of the box-shaped core support member 400, and the lap 411 is bonded. It is then inverted upside down as shown by the left drawing of FIG. 4B. Referring to the left drawing of FIG. 4B, thin metal sticks are inserted into the respective windows as the space (gap) at the corner portions of the core support member 400 for filling along the arc-shape of the corner portion of the transformer. When filling is finished, the core support member 400 having the amorphous core inserted is further inverted upside down again as shown in the right drawing of FIG. 4B.

The thus structured box-shape core support members are arranged in the single row as shown in FIG. 1D to form the 3-phase 5-leg amorphous core. The core support members as shown in FIG. 4B may be arranged in two rows likewise the one shown in FIG. 2B to increase the core width for coping with the transformer with large capacity.

FIG. 5A to 5D show modified examples of the corner core support member.

Figure 5A:
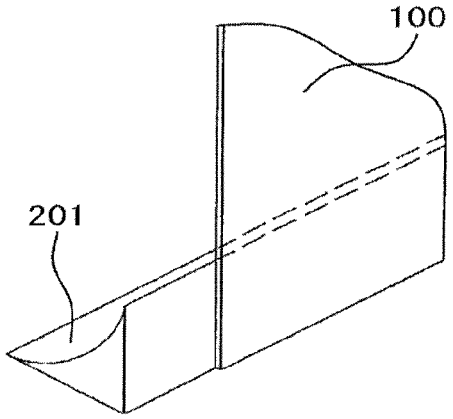
FIG. 5A is a partial perspective view of the corner support member for supporting the core corner portion according to the present invention, showing the same structure as the one shown in FIG. 1A.

FIG. 5A shows the same structure as the one shown in FIG. 1A. The corner portion of the core is supported at the support member 201 which has a solid continuous structure shaped along the radius R of the corner portion of the core. If the support member with the aforementioned structure is formed of metal, the supporting function is sufficiently performed. However, because of the solid structure, increased weight tends to cause the entire structure to be heavy.

Figure 5B:
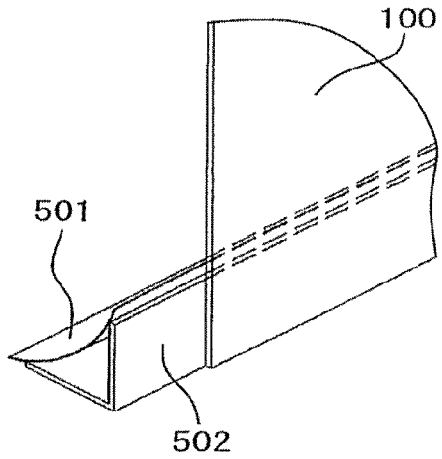
FIG. 5B is a partial perspective view of a corner support member according to another example of the present invention, showing a combination of a support plate partially having a radius R and an L-shaped support plate.

FIG. 5B shows that a structure formed by combining a support plate 501 with the radius R and an L-shaped support plate 502 for supporting the plate. When integrating the support plate 501 with the radius R and the L-shaped support plate 502 through the welding may intensify the strength. A hollow portion is defined by the plate 501 with the radius R and the L-shaped plate 502, and accordingly, the weight of the support member may be reduced.

Figure 5C:
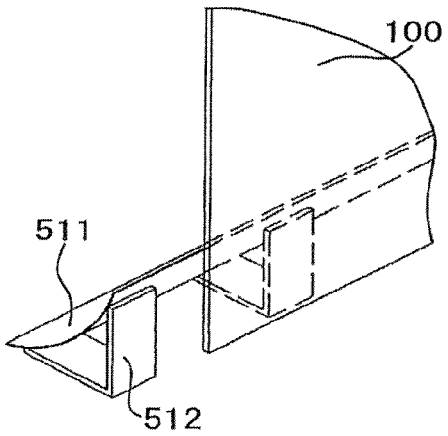
FIG. 5C is a partial perspective view of a corner support member according to another example of the present invention, showing a combination of the support plate partially having a radius R and L-shaped support plates each having a predetermined width and arranged at predetermined intervals.

FIG. 5C shows a plurality of support plates 511 each with the radius R obtained by cutting the continuous L-shaped support plate 501 as shown in FIG. 5B in the predetermined dimension are arranged at predetermined intervals for supporting the corner portion of the core. This structure may further reduce the weight compared to the structure shown in FIG. 5B.

Figure 5D:
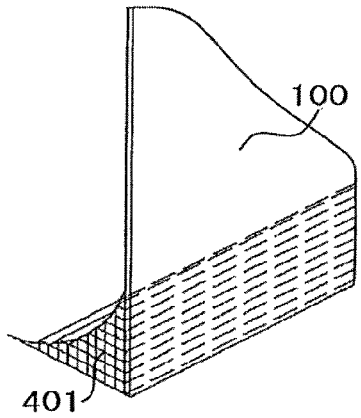
FIG. 5D is a partial perspective view of the corner support member shown in FIG. 4B, showing the structure formed by laminating thin metal sticks to form an arc-like shape.

FIG. 5D is a partially enlarged view of the structure shown in FIG. 4B. As described above, the corner support member is formed by inserting thin metal sticks into the space (gap) to be filled along the arc-like corner portion of the transformer. The structure follows the arc more closely as the stick becomes thinner.

Figure 6:
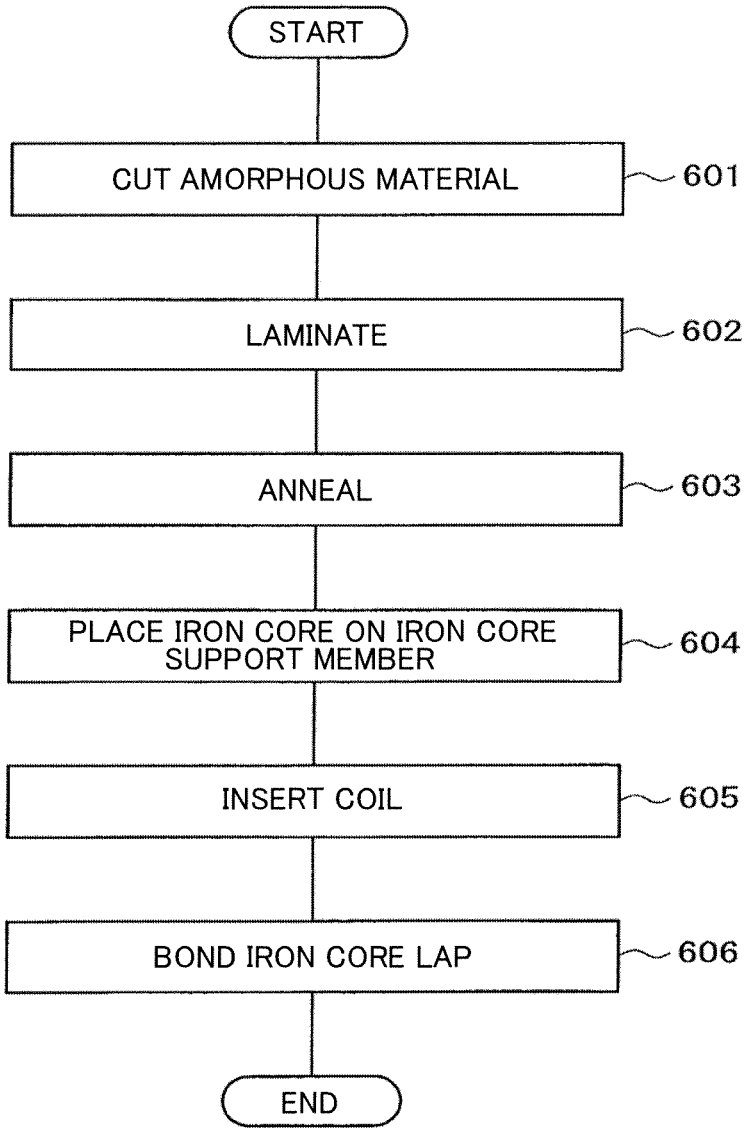
FIG. 6 is a flowchart representing the process for assembling the amorphous core and the coil according to the present invention.
Figure 7:
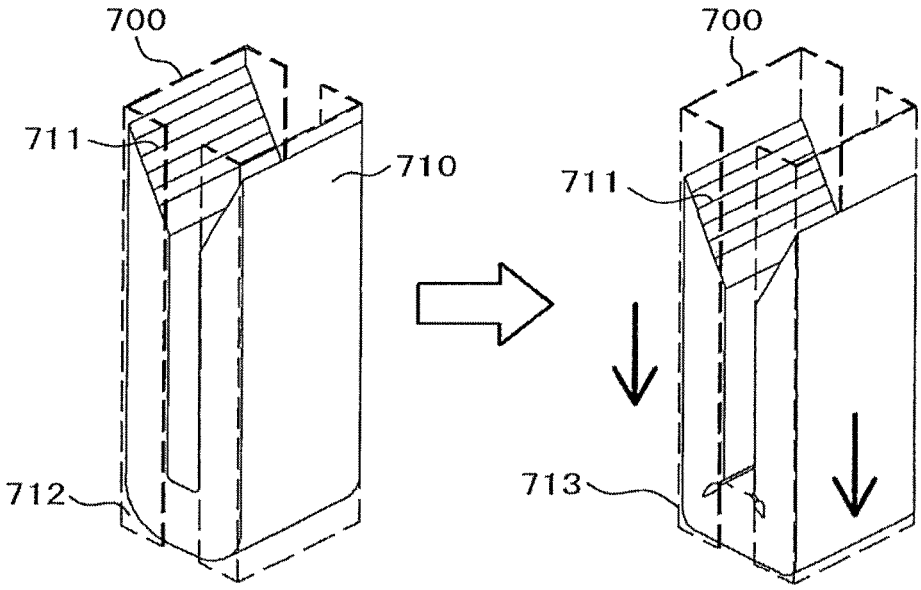
FIG. 7 is explanatory views representing the problem resulting from assembly of the amorphous core as related art.

FIG. 6 is a flowchart representing the method for assembling the amorphous transformer according to the present invention. Each step of the process will be described referring to the flowchart.

In the method for assembling the amorphous transformer according to the present invention, the hoop-like wound amorphous material is pulled and cut in a predetermined length in step 601. Then the cut amorphous material with the predetermined length is positioned and laminated in laminating step 602.

Subsequent to the laminating step 602, the core is subjected to rectangular shaping process (not shown) so as to have a U-like configuration. After subjecting the core to the rectangular shaping, it is annealed in annealing step 603. Annealing is performed to eliminate strain in the core resulting from deformation caused in the rectangular shaping, and further to improve properties.

After annealing the core, it is set in the support member in step 604. After setting the core in the core support member, the coil is fitted with the core and the core support member in coil fitting step 605. After fitting the coil, the lap for the core is bonded in lap bonding step 606. After finishing the lap bonding step, the assembly of the core and the coil is completed.

The present invention is not limited to the example as described above, but may be changed into various forms.

For example, the example has been described in detail for explicitness of the present invention. The present invention is not limited to the one with all the structures which have been described. The structure of the example may be partially replaced with the other example, or added to the other example. The structure of each of the examples may be partially added, removed, and replaced as well.

For example, all the core support members may be integrally formed or separately formed. The dimension of the support member and the number of the portion in contact with the core may be added or reduced.

What is claimed is:

1. An amorphous transformer comprising:

an amorphous core formed of an amorphous material with a lap provided at an upper portion and allowed to stand in substantially a vertical direction while being supported by a core support member; and a coil which is fitted with the amorphous core, wherein:

the core support member is formed by integrating a side support member for supporting a side surface of the amorphous core and a corner support member for supporting a corner portion of the amorphous core, the corner support member includes a curved support plate and an L-shaped support plate for supporting the support plate, the curved support plate having a shape which follows a curved surface of the corner portion of the amorphous core, and the curved support plate and the L-shaped support plate forming a hollow structure, and the amorphous core and the side support member are inserted into the coil.

2. The amorphous transformer according to claim 1, wherein the side support member is provided in a substantially vertical direction along at least one of the side surfaces of the amorphous core.

* * * * *